US009945012B2

(12) United States Patent
Bouchard

(10) Patent No.: US 9,945,012 B2
(45) Date of Patent: Apr. 17, 2018

(54) METAL MATRIX COMPOSITE AND METHOD OF FORMING

(71) Applicant: National Research Council of Canada, Ottawa (CA)

(72) Inventor: Dominique Bouchard, Chicoutimi (CA)

(73) Assignee: National Research Council of Canada, Ottawa, Ontario (CA)

( * ) Notice: Subject to any disclaimer, the term of this patent is extended or adjusted under 35 U.S.C. 154(b) by 234 days.

(21) Appl. No.: 14/767,170

(22) PCT Filed: Feb. 11, 2014

(86) PCT No.: PCT/CA2014/000102
§ 371 (c)(1),
(2) Date: Aug. 11, 2015

(87) PCT Pub. No.: WO2014/121384
PCT Pub. Date: Aug. 14, 2014

(65) Prior Publication Data

US 2015/0376745 A1 Dec. 31, 2015

Related U.S. Application Data

(60) Provisional application No. 61/763,186, filed on Feb. 11, 2013.

(51) Int. Cl.
*C22B 21/00* (2006.01)
*C22B 21/06* (2006.01)
(Continued)

(52) U.S. Cl.
CPC ..... *C22C 32/0031* (2013.01); *B22D 19/14* (2013.01); *C22B 21/0084* (2013.01);
(Continued)

(58) Field of Classification Search
CPC ..... B22D 19/14; C22B 21/0084; C22B 21/06; C22B 21/062; C22C 1/026; C22C 1/1036; C22C 1/21; C22C 32/0036
See application file for complete search history.

(56) References Cited

U.S. PATENT DOCUMENTS 6,458,466 B1 10/2002 Jones
6,506,502 B2 1/2003 Lo
(Continued)

FOREIGN PATENT DOCUMENTS

CN 202936437 5/2012
CN 202968612 6/2013
(Continued)

OTHER PUBLICATIONS

Davis, Joseph R., ed. Aluminum and Aluminum Alloys. ASM International, 1993. pp. 160-161.*
Tsuchitori, Isao et al. JP H07102331 A. published Apr. 1995. machine translation.*
Marsh, Sherman P. et al., "Rutile in Precambrian Sillimanite-Quartz Geiss and Related Rocks, East-Central Front Range, Colorado", Washington: United States Government Printing Office, 1976. 23 pages.*
(Continued)

*Primary Examiner* — George Wyszomierski
*Assistant Examiner* — Tima M McGuthry Banks
(74) *Attorney, Agent, or Firm* — Jason E. J. Davis

(57) ABSTRACT

Use of Ca in metal matrix composites (MMC) allows for incorporation of small and large amounts of ceramic (e.g. rutile $TiO_2$) into the metal (Al, or its alloys). Calcium remains principally out of the matrix and is part of a boundary layer system that has advantages for integrity of the MMC. Between 0.005 and 10 wt. % calcium (Ca) may be included, and more than 50 wt. % of rutile has been shown to be integrated. Rutile may therefore be used to reduce melt loss due to calcium from an aluminum or aluminum alloy melt.

47 Claims, 5 Drawing Sheets

(51) Int. Cl.

| | |
|---|---|
| ***C22C 1/02*** | (2006.01) |
| ***C22C 1/03*** | (2006.01) |
| ***B22D 19/14*** | (2006.01) |
| ***C22C 32/00*** | (2006.01) |
| ***C22C 21/00*** | (2006.01) |
| ***C22C 29/12*** | (2006.01) |
| ***C22C 1/10*** | (2006.01) |
| ***C22C 14/00*** | (2006.01) |
| ***C22C 30/00*** | (2006.01) |
| ***C22C 5/04*** | (2006.01) |

(52) U.S. Cl.

CPC ..... *C22B 21/06* (2013.01); *C22B 21/062* (2013.01); *C22C 1/02* (2013.01); *C22C 1/026* (2013.01); *C22C 1/1036* (2013.01); *C22C 5/04* (2013.01); *C22C 14/00* (2013.01); *C22C 21/00* (2013.01); *C22C 29/12* (2013.01); *C22C 30/00* (2013.01); *C22C 32/0036* (2013.01); *C22C 2001/1047* (2013.01)

(56) References Cited

U.S. PATENT DOCUMENTS

| | | | | |
|---|---|---|---|---|
| 8,647,536 | B2 | 2/2014 | Russell | |
| 9,138,806 | B2 | 9/2015 | Nabawy | |
| 2004/0202883 | A1 | 10/2004 | Scheydecker et al. | |
| 2013/0189151 | A1 | 7/2013 | Vivek | |
| 2014/0037494 | A1* | 2/2014 | Lee ..... | B22D 21/04 420/528 |

FOREIGN PATENT DOCUMENTS

| | | | |
|---|---|---|---|
| EP | 0324706 | | 7/1985 |
| EP | 0291441 | | 11/1988 |
| EP | 0346771 | | 12/1989 |
| JP | 60-138041 | | 7/1985 |
| JP | 60-159137 | | 8/1985 |
| JP | 01-108326 | | 4/1989 |
| JP | 07-102331 | | 4/1995 |
| JP | 07102331 | A * | 4/1995 |
| WO | 2005069972 | | 8/2005 |
| WO | WO 2012128506 | A2 * | 9/2012 |

OTHER PUBLICATIONS

International Preliminary Report on Patentability of corresponding PCT application No. PCT/CA2014/000102.

English Machine Translation of Japan Publication No. 07-102331.

English Machine Translation of Japan Publication No. 60-159137.

English Machine Translation of Japan Publication No. 01-108326.

English Machine Translation of Japan Publication No. 60-138041.

English Machine Translation of Abstract and Claim 1 of China Publication No. 202936437.

English Machine Translation of Abstract of China Publication No. 202968612.

Chaudhury et al., Influence of Ti02 particles on recrystallization kinetics of A1-2Mg—Ti02 composites, Journal of Mat. Proc. Tech 182 (2007) 540-548.

Chaudhury, et al., Preparation and thermomechanical properties of stir case A1-2Mg—11TiO2 (rutile) composite, Bull. Mater. Sci., vol. 27, No. 6, Dec. 2004 pp. 517-521.

Hashim, J., et al., The wettability of SiC particles by molten aluminium alloy, Journal of Materials Processing Tech. 119(2001)324-328.

Rohatgi, P., Featured Overview Cast Aluminum-Matrix Composites for Automotive Applications, JOM, Apr. 1991, vol. 43, Issue 4, pp. 10-15.

Hur, B., et al., Viscosity and Surface Tension of Al and Effects of Additional Element, Mat. Sci. Forum, vol. 438 (2003) pp. 51-56.

Banhart, J., Manufacturing routes for metallic foams, JOM 52 (12), 2000, pp. 22-27.

Aluminum Project Fact Sheet, Effect of Impurities on Alloys, Effect of Impurities on the Processing of Aluminum Alloys, Department of Energy, www.oit.doe.gov.

Kaufman, J.G., et al., Aluminum Alloy Castings: Properties, Processes and Applications, Chapter 3, pp. 36-37.

Extended European Search Report, dated Sep. 23, 2016, of corresponding PCT application No. PCT/CA2014/000102.

International Search Report, dated May 20, 2014, of corresponding PCT application No. PCT/CA2014/000102.

Written Opinion, dated May 20, 2014, of corresponding PCT application No. PCT/CA2014/000102.

* cited by examiner

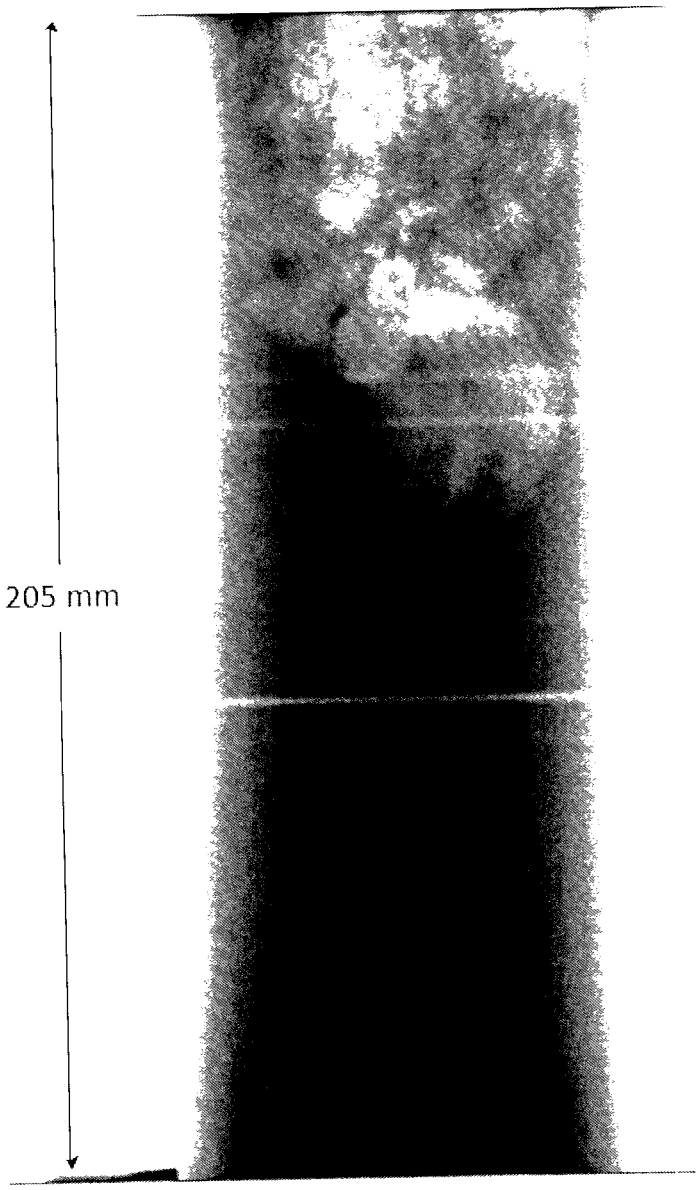
FIG, 1a

FIG. 2a
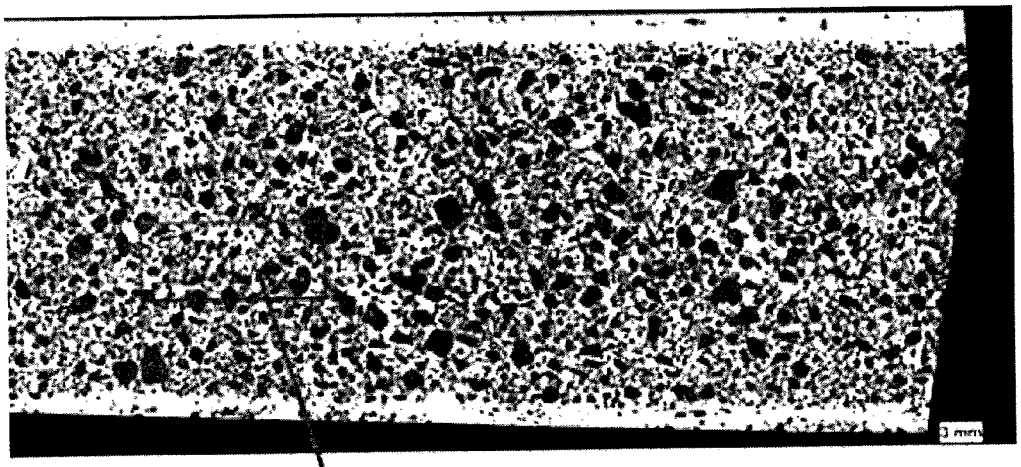
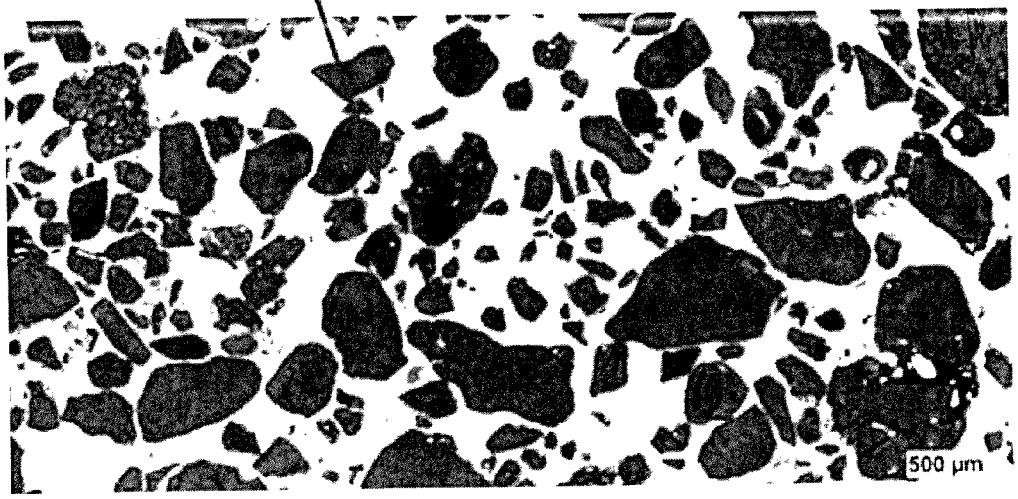
FIG. 2b

METAL MATRIX COMPOSITE AND METHOD OF FORMING

CROSS-REFERENCE TO RELATED APPLICATIONS

This application is a national phase entry of International Patent Application No. PCT/CA2014/000102 filed Feb. 11, 2014 and claims the benefit of U.S. Provisional Patent Application Ser. No. 61/763,186 filed Feb. 1, 2013, the entire contents of both of which are herein incorporated by reference.

FIELD OF THE INVENTION

The present invention relates in general to metal matrix composites (MMCs) and methods of forming MMCs, and in particular to the use of calcium to improve integration of ceramics in aluminum containing metal matrices.

BACKGROUND OF THE INVENTION

MMCs are a class of materials having many applications where mechanical properties such as strength, abrasion resistance, thermal resistance, or lightness are sought. MMCs are composed of a metal matrix and reinforcement. Herein the reinforcements include, and are preferably composed principally of, ceramics or cermets. There are many fabrication routes for generating MMCs, but typically a lowest cost route involves melting the metal, adding powdered ceramics or cermets, stirring, and then cooling the mixture to solidify. This production route is often called 'stir casting'. The cooling may be performed by casting the mixture, by injection molding or by extrusion using a variety of techniques known in the art.

There are problems in the art with choosing reinforcement and metal materials. Some candidates react with each other. For example, it was natural to try carbon fibers in aluminum, as both are used in the aerospace industry for their lightness and strength. However, aluminum reacts with carbon to form $Al_4C_3$, which is brittle, moisture sensitive, and therefore problematic. Therefore carbon fibers are typically coated to prevent this reaction. Such coatings add cost and difficulties to the production of MMCs, and introduce other problems. The coating has to reliably passivate the carbon, on one side and present a non-reactive surface to the metal on the other.

If the reinforcement is selected (or coated) so that it does not react with the molten metal, there is still an important hurdle to producing useful MMCs: integration. The interfaces between the reinforcement and the liquid metal, when there is low affinity between the metal and reinforcement, are crucial to the strength of the material. Liquid metals and particularly aluminum typically exhibit poor wetting with reinforcement particles. In many cases this is attributable to the formation of a matrix oxide layer at the interface with the particles that hinders intimate contact. If the interfaces are not wetted, even with good mixing, and equal net forces on the reinforcements and metal, separation of the reinforcements and metal are likely, leading to a generally unwanted bulk mixture that is heterogeneous. This heterogeneity may be exacerbated by thermal contraction during solidification, which typically affects the metal much more than the reinforcements.

The more ceramic in the mixture, the more wetting is required to produce a MMC solid that is free of voids to form monolithic, integrated materials. Generally, the smaller the sizes of the surfaces of the reinforcement, the more wetting is required for integration. This is unfortunate because it is desired to retain small reinforcement particle sizes for some applications, and a range of reinforcement to matrix ratios are frequently desired.

Thus it is known in the art to use wetting agents in liquid metal and ceramic mixtures to promote intimate contact between the powders and metal. Magnesium seems to be the preferred wetting agent. For example, [1] Chaudhury teaches a stir casting method of producing a MMC with Al as the metal, and rutile $TiO_2$ powders as the reinforcement. It is noted that using finer rutile particles led to a high rejection rate, and limited amounts of the powder could be retained in the melt. About 2 wt. % of magnesium was plunged into the melt to increase wettability. Even with the Mg, only 11 wt. % of $TiO_2$ was successfully incorporated into the melt, and a greater degree of segregation of the $TiO_2$ from the Al was observed at the top in comparison with the bottom of the castings, which indicates a lack of uniformity. Furthermore microvoids were observed in the particle rich zones.

According to [2] Hashim et al., addition of alloying elements can help. Excellent bonding between ceramic and molten matrix can be achieved when reactive elements are added to induce wettability. For example, addition of magnesium, calcium, titanium, or zirconium to the melt may promote wetting by reducing the surface tension of the melt, decreasing the solid-liquid interfacial energy of the melt, or inducing wettability by chemical reaction. According to [2], it has been found that magnesium has a greater effect in incorporating reinforcement particles into aluminum based melts than others that were tried, including cerium, lanthanum, zirconium, titanium, bismuth, lead, zinc, and copper. Mg successfully promotes wetting of alumina, and is thought to be suitable in aluminum with most reinforcements.

[3] Rohatgi reviews cast Al MMCs for automotive applications. It mentions that stir casting and pressure infiltration are two solidification techniques that both require mixing and wetting between the molten alloys and reinforcements. According to [3]: "High-strength, high-stiffness polycrystalline $\alpha$-alumina ($Al_2O_3$)/Al composites have been prepared by a pressure-infiltration process. For nonwetting metals, the $\alpha$-$Al_2O_3$ is coated with a metal by vapor deposition or by electroless plating before infiltration. Titanium-boron coatings have also been used for graphite (Gr)/Al and $Al_2O_3$/Al composites. However, in terms fabricability and cost, modification of the matrix by adding small amounts of reactive elements (e.g., Mg, Ca, Li or Na) is preferred. Alumina-reinforced aluminum composites, as well as several particle-filled MMCs, have been synthesized by adding reactive agents to the melts."

Typically MMCs produced by stir casting (as opposed to the infiltration techniques that can incorporate very large amounts of reinforcements but require a costly and time-consuming ceramic pre-form to be fabricated beforehand) are substantially limited in the amount of reinforcement they can include. So the table III of Al MMCs in [3] shows that all of the MMCs have 5-20 wt. % of reinforcements, except Lanxide, which used the pressure infiltration process, which is more expensive than the preferred stir casting technique (as expressly noted therein). It should also be noted that the very high concentrations of reinforcements in these applications are associated with significantly greater strength and modulus than the 5-20 wt. % MMCs. All of the reinforcements used were ceramic powders (except for short fibres used by Honda).

Some information can be gleaned about the effect of calcium on surface tension from work on metal foams, and the distribution of calcium oxide within foamed metal, for example from [4] Hui, and [5] Banhart. While it is not exactly clear in these two references what the effect is, it does appear to have a notable effect on the viscosity and surface tension of a foaming metal. Per [4], the surface tension of commercially pure Al, drops rapidly with the addition of 2 wt. % of Ca.

While calcium may be included in foamed metal compositions in order to control frothing, calcium is not a particularly inviting element to include in Al melts. According to [6] calcium, lithium, and sodium are elements that are regarded as impurities in many aluminum alloys. The impurities contribute to the rejection rate of aluminum sheet and bar products. Rejected products must be remelted and recast. During this process, a portion of the aluminum is lost to oxidation (melt loss). Removal of calcium, lithium, and sodium increase overall melt loss of aluminum alloys. These impurities increase the hydrogen solubility in the melt and promote the formation of porosity in aluminum castings. According to Aluminum Alloys Castings Properties, Processes and Applications Chapter 2/15, Section 2.5.6: Calcium is a weak aluminum-silicon eutectic modifier. It increases hydrogen solubility and is often responsible for casting porosity at trace concentration levels. Calcium greater than approximately 0.005% also adversely affects ductility in aluminium-magnesium alloys.

Accordingly there is a need for a technique for improving integration of ceramic powders into molten metal to produce MMCs that can be stir cast, for example, especially techniques that allow for the integration of a greater amount of the ceramic powders.

SUMMARY OF THE INVENTION

While Ca may offer an essential control for the foaming of metal, and while Ca is included in several lists of possible, untried, wetting agents possibly suitable for Al for melt casting, and even though Ca is known to decrease surface tension of Al, it had not been tried, it was not obvious to work as a wetting agent, it was not obvious that working as a wetting agent, or other agent for improving integration, that it wouldn't also lead to high rejection rates of MMCs.

Applicant has unexpectedly discovered that calcium is a far better additive to promote integration of ceramics in aluminum than magnesium is, at least when the ceramic is rutile $TiO_2$, or the like. In fact, the use of Ca, in small amounts, has a remarkable ability to allow for more than 50 wt. % of rutile $TiO_2$ into an aluminum melt with a stir casting technique. No high concentration stir-cast MMCs were previously known in the art. Anatase $TiO_2$ (a polymorph of $TiO_2$ different only from rutile in a crystal structure) was tried and it did not integrate well with the melt with equal amounts of Ca, which shows that the knowledge that Ca reduces surface tension of Al does not ensure that it would improve the integration of powders of reinforcing ceramics. The rutile polymorph is inherently more stable than the anatase, so if free energy were a guide, it would be expected that anatase would be the more likely polymorph to form a stable metal-ceramic interface. Apparently kinetic barriers are still present for the incorporation of particles even when a reduction of surface tension conducive to improved particle wetting has been achieved. Therefore, the effect of calcium additions to improve the integration of rutile in liquid aluminum cannot be explained only in terms of its role as a wetting agent. Furthermore, while Ca is a stronger oxygen scavenger than Ti or Al, it was by no means certain that Ca would be substantially confined to the oxide-containing ceramic regions of the MMC, as was found. Finally, a calcium-containing boundary system appears to form around rutile that is associated with improved integration with the Al-containing matrix.

Accordingly, a method for producing a metal matrix composite is provided, the method comprising mixing a reinforcement with an aluminum-containing molten or semisolid metal or alloy and between 0.005 and 10 wt. % calcium (Ca), wherein the reinforcement is composed of particles each having a surface bearing at least 20% of titanium oxide ($TiO_2$), and the $TiO_2$ is predominantly of crystal form other than anatase; and cooling the mixture to produce a solid metal matrix composite.

The reinforcement may be a cermet or ceramic powder including the $TiO_2$, or a compound coated with the $TiO_2$. The $TiO_2$ may be in a rutile or brookite crystal form. Rutile $TiO_2$ has been proven. The mixture may consist of at least 60 wt. %, more preferably 80 wt. %, more preferably 90 wt. %, more preferably 95 wt. %, more preferably 97 wt. % of the reinforcement and molten metal. The molten or semisolid metal may be liquid aluminum of a predetermined purity.

The molten metal may include aluminum, and at least one alloying metal in liquid or semisolid form with the aluminum, other than magnesium. The molten metal may be composed of more Al than any other element by weight.

The particles may be spherical, cubic, prismatic, polyhedral, angular, amorphous, elongated, rod-like, tubular, conic, fibrous, filamentary, platelet-like, disc-like, irregular, or any combination of the above. The surfaces of the particles may be flat, or curved, smooth or rough, randomly textured or patterned, concave or convex, or any combination of the above. The particles may have a predefined distribution of dimensions, with less than 10% of the reinforcements having dimensions greater than a maximum dimension, which is less than 1 cm, and with less than 10% of the reinforcements having dimensions smaller than a minimum dimension, which is greater than 10 nm. Each surface of the typical particle may bears at least 20%, or more preferably at least 60% of $TiO_2$.

Cooling the mixture to produce a solid metal matrix composite may comprise: sandcasting, die casting, centrifugal casting, compocasting, thixocasting, rheocasting, thixomolding or other semisolid forming, pressure die casting, injection molding or extrusion.

Also accordingly, a metal matrix composite (MMC) is provided. The MMC comprising a metal matrix of a first metal or alloy; and numerous sub-milimeter dimension embedded particles of a metal-oxide ceramic distributed throughout the metal matrix, wherein 0.005 to 10 wt. % calcium is present, and a concentration of calcium within the embedded particles and surrounding the embedded particles is more than double a concentration of the calcium in the metal matrix away from the embedded particles.

The oxides of calcium may be more highly concentrated at a periphery of the particles than within the ceramic clusters, linking the first metal and the ceramic clusters. The ceramic particles preferably include titanium dioxide ($TiO_2$), calcium oxide and aluminum oxide, and the first metal is aluminum or an alloy of aluminum. The ceramic particles and first metal or alloy are preferably present in a ratio of between 80:20 to 0.1:99.9 wt. %; more preferably in a ratio of between 65:35 to 1:99 wt. %, or between 55:45 to 5:95 wt. %, as specifically shown.

Furthermore a method is provided for reducing melt loss due to calcium defects in parts formed from an aluminum or aluminum alloy melt, the method comprising estimating a molar amount of calcium present, and adding at least an equal molar amount of rutile titania to the aluminum or aluminum alloy melt.

Further features of the invention will be described or will become apparent in the course of the following detailed description.

BRIEF DESCRIPTION OF THE DRAWINGS

In order that the invention may be more clearly understood, embodiments thereof will now be described in detail by way of example, with reference to the accompanying drawings, in which.

DESCRIPTION OF PREFERRED EMBODIMENTS

Figure 1B:
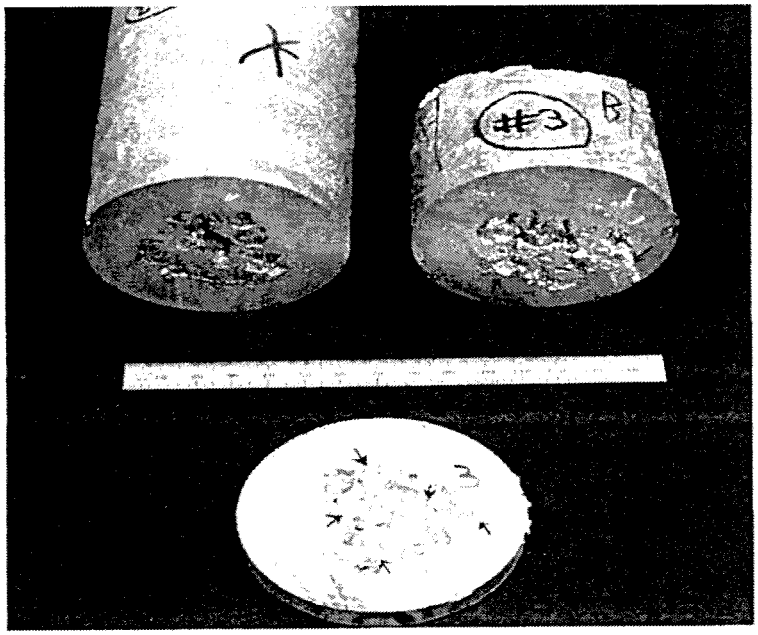
FIGS. 1*a, b* show separation of rutile titania in molten aluminum shown on an X ray image and photograph, respectively.

Herein a MMC material system is described, the material system formed of at least a metal matrix that includes aluminum, and embedded reinforcements dispersed within the matrix. The reinforcements are composed of, or coated with ceramic particles, which may be a ceramic oxide, boride, carbide, nitride or graphite. More preferably the ceramic is an oxide or boride, or a ceramic that has a naturally formed oxidization layer, such as silicon carbide, for example. More preferably the ceramic is an oxide, such as titania in a crystal form other than anatase. More preferably the ceramic is rutile titania, brookite titania, or a combination thereof. Most preferably the ceramic is rutile.

An interface region is formed at the boundaries between the ceramic and matrix. The interface region includes Ca, and the concentration of Ca in the interface region is far greater than the concentration of Ca in the metal matrix. Preferably the Ca is effectively not present in the metal matrix away from the interface region. The Ca may be effectively only in the interface region, or effectively only in the interface region and within the reinforcements. The preferred order for affinities for oxygen of these metals is preferably calcium, matrix metal and the ceramic (and its constituents). Rutile $TiO_2$ has a particular ability to react with calcium in the metal matrix, and thus even though calcium can be a problem in aluminum and aluminum alloys, it can be effectively used to promote the integration of ceramics since its reaction has been found to remove it from the matrix.

A method of producing a MMC involves mixing reinforcements with an aluminum-containing molten metal, and between 0.005 and 10 wt. % Ca (more preferably 0.005 to 5 wt. %, and more preferably from 0.01 to 2.5 wt. %), wherein the reinforcements are particles that have a surface bearing at least 20% of titanium oxide ($TiO_2$), in a crystal form other than anatase (preferably rutile), and cooling the mixture to produce a solid metal matrix composite. The titania may include brookite, which is expected to equally improve integration, given similarities in the crystal structures of the two polymorphs. The crystal structure of brookite is compatible with rutile, and brookite can grow epitaxially on rutile. Anatase, on the other hand, has a very different crystal structure, which is evidently less compatible with the formation of the calcium-containing composition observed. It is noted that brookite is a relatively scarce polymorph of rutile.

The reinforcements may be ceramic or cermet, and may consist of ceramic compositions having a variety of grains of different composition, crystal form, or shape. The particles are typically dense, if a strong MMC is desired. Some properties of ceramics are achieved only with particles smaller than a given size, and frequently the size is in the nanometer scale. The addition of Ca, given the markedly improved integration of rutile with Al-containing metals and alloys, may allow for higher ceramic content in the MMC, or for better integration of finer rutile reinforcements, or other reinforcements coated with rutile powder.

The reinforcements typically have all dimensions smaller than 1 cm and may be nanostructured or microstructured, coated with rutile, a cermet of rutile in a metal (the same as or different than the matrix metal), or monolithic. The reinforcements may have any distribution of sizes, angularities, or surface areas, although are expected to have at least one sub-milimeter, and often sub-micron dimension. Substantially equiaxed powders may be preferable in many applications, although fibres, filaments and rods, and platelets, discs or flakes may be useful in others. The presence of rutile on the surface of the powders permits the formation of a Ca containing boundary layer that links the metal matrix and the particles which may improve adherence of the MMC, and may improve longevity of the MMC, and further attracts the Ca away from the metal matrix.

The molten metal is preferably Al or an alloy of Al (with at least 10%, or more preferably 20, 30, 40, 50, 60, 70, 80, 90, 95, 97, 99 wt. % or more of Al). If a high ceramic content is desired (i.e. more than 35 wt. %), the alloy may preferably not contain Mg. Even moderately small amounts of Mg (2%) have been found to impair the integration of high concentrations of rutile by liquid Al, although greater amounts of Ca, and other alloys of Al may reduce this effect. The metal matrix may contain moderately small amounts of boron, or other metals, and may include other reinforcements (be they ceramic or other) not linked to the matrix, by a systematically Ca-containing boundary layer.

If a molten alloy of Al is used, preferably no alloying metal present in substantial quantities, have a higher affinity for oxygen than Ca. Any alloying metals included preferably do not react more readily with the reinforcements than Al, or otherwise impede the reactions between the Al, Ca, and ceramic.

The MMC may be composed entirely of the monolithic ceramic powder, molten metal, and Ca, each with their respective impurities. Alternatively other reinforcements, solid metals in the molten metal (forming a semi-solid) or other alloying materials, or other materials may be present, and so the mixture may be at least 60 wt. %, more preferably 80 wt. %, more preferably 90 wt. %, more preferably 95 wt. %, more preferably 97 wt. % of the powder and molten metal.

Cooling the mixture to produce a solid metal matrix composite may involve known processes such as: sandcasting, die casting, centrifugal casting, compocasting, thixocasting, rheocasting, thixomolding or other semisolid forming, pressure die casting, injection molding or extrusion.

This method may produce a metal matrix composite (MMC) formed of a metal matrix of a first metal or alloy; and numerous sub-milimeter dimension embedded particles distributed uniformly throughout the metal matrix, wherein 0.005 to 10 wt. % calcium is present, but is at least mostly confined within a boundary layer produced around the ceramic particles. For example a concentration of calcium confined to the embedded particles and surrounding the embedded particles, is more than double a concentration of the calcium in the metal matrix away from the embedded particles. The concentration of calcium within and around the embedded particles may be more than 10 times, more than 50 times, and more than 100, or 1000 times the concentration of calcium in the metal matrix away from the embedded particles.

With the formation of a boundary layer around the embedded particles, the calcium may be more highly concentrated at a periphery of the particles than within the particles themselves. The boundary layer may better link the first metal and the ceramic clusters. The embedded ceramic particles may include titanium, calcium, oxygen, and aluminum, and the first metal may be aluminum or an alloy of aluminum, and preferably the embedded ceramic particles were prepared from compounds of known purities of rutile titanium oxide ($TiO_2$), with calcium oxide and substantially aluminum oxide, and the first metal is aluminum or an alloy of aluminum.

As calcium is a known impurity for Al, and as rutile titania is abundant, it also makes sense to treat the rutile as an additive that compensates for and effectively removes the Ca from Al. As such rutile titania may be used to reduce melt loss, energy, labour, and processing when an aluminum metal or alloy is known to contain calcium.

EXAMPLES

Applicant has experimented with the incorporation and integration of $TiO_2$ in liquid aluminum. Specifically, approximately 50 g of rutile $TiO_2$ powder (99.9%, <5 μm, 4.17 g/cm$^3$, product No. 224227, Sigma-Aldrich), was folded in an aluminum foil and placed at the bottom of a steel crucible. Commercially pure aluminum (>99.9%, Al PO404, AIM Metals and Alloys) was melted in an electric furnace at a temperature of approximately 720° C. and then poured in the steel crucible over the foil which freed the powder as it melted. A total of 5 slugs were produced in this manner and it was observed during these trials that the $TiO_2$ tended to rise to the surface. An X-Ray inspection system (model Y Multiplex 5500 M, 225 kV, variofocus tube, YXLON) was used to examine the slugs and revealed the presence of large porosity in their upper portions, a typical radiograph being shown in FIG. 1*a*. Large defects are shown in the upper portions of the slug by the radiograph. The slugs were then sliced for internal examination, and are photographed (presented as FIG. 1*b*). The presence of large porosity originating from solidification shrinkage was observed as well as some $TiO_2$ powder clustered inside the cavities. Some white $TiO_2$ power was found clustered in some of the cavities.

An examination with a scanning electron microscope (Hitachi SU-70 FEG SEM) revealed that the $TiO_2$ powder was mainly located in the shrinkage porosity and had remained unwetted by aluminum. The chemical composition provided by the energy dispersive X-ray spectroscopy (EDS) system (Oxford EDS INCA 300) showed the presence of aluminum, oxygen and titanium along with some contaminants.

No evidence was found of aluminum reacting with the $TiO_2$. Aluminum has a very high affinity for oxygen, its reaction producing aluminum oxide, $Al_2O_3$. This compound is more stable than titanium oxide, $TiO_2$, and some reduction would thus be expected when $TiO_2$ additions are made to liquid aluminium unless kinetic barriers are present. Moreover, titanium has limited solubility in liquid aluminium (<1 wt % at 800° C.) and titanium aluminides would be expected to form even when a small amount of $TiO_2$ is reduced. With sufficient mass fractions of $TiO_2$ in liquid aluminum, aluminum oxide and titanium aluminide would be expected to be produced according to the following exothermic reaction: $3\ TiO_2 + 7\ Al \rightarrow 2\ Al_2O_3 + 3\ TiAl$. The results from the gravity casting showed a tendency for $TiO_2$ to agglomerate and poor integration with liquid aluminum. There is no sign of a chemical reaction between the Al and titania.

Additional tests to evaluate the incorporation of $TiO_2$ were carried out with the stir-casting technique and an attempt to produce wedges by high pressure die casting with this slurry was made. In these tests, anatase $TiO_2$ was used (≥99%, <44 μm, 3.9 g/cm$^3$, product No. 248576, Sigma-Aldrich). Approximately 90 kg of aluminum (>99.9%, Al P0404, AIM Metals and Alloys) was melted in an electric furnace and a vortex in liquid aluminum was created by the rotating impeller of a mixer. The anatase was first heated to 300° C. for at least 1 hour to remove moisture and a total of 9 kg was poured into the vortex by incremental additions of 300 g batches.

Agglomeration and lack of wetting were again observed with this mode of incorporation and once the vortex stopped, the $TiO_2$ immediately separated from the melt and floated to the surface. Although the supplier specified a density of 3.9 g/cm$^3$ for the anatase $TiO_2$, the apparent density was measured to be 0.5 g/cm$^3$ and combined with the lack of wetting, is believed to account for the observed rise to the surface of liquid aluminum (ρAl=2.4 g/cm3). The high pressure die casting trials also failed to produce presentable wedges and the separation of the solid $TiO_2$ from the liquid aluminium was the main reason.

Experiments were performed to assess the effect on integration of two different $TiO_2$ forms (rutile and anatase) having different granulometry and hence different apparent densities, and the effects of small additions of boron, magnesium and calcium metals (that could modify wetting of aluminum with $TiO_2$). A two-level screening design comprising 16 trials was selected, having for response variable the amount of $TiO_2$ that could be incorporated in aluminum.

These tests were performed in a small furnace with a capacity to melt approximately 5 kg of aluminum. A mechanical stirrer (IKA, model RW20DWMNS1, Fischer Scientific) mounted with a steel impeller was used for mixing the $TiO_2$. Oxidation of aluminum was reduced with argon at a flow rate of 15 L/min that was supplied by a ring placed above the crucible and made with a copper tube (¼") having perforated holes.

The anatase was the same as described above (product No. 248576, Sigma-Aldrich) while the rutile was supplied by Rio Tinto Iron and Titanium (>97% pure, UGSTM, 300-350 μm, ρ=3.9 g/cm$^3$, ρapp=1.87 g/cm$^3$). In all instances, the $TiO_2$ powder was heated to 300° C. for at least 1 hour to remove moisture. Magnesium (99.9%, Rand Alloys) was added to the melt while calcium (Al-10% Ca, Rand Alloys) and boron (Al-4% B, AIM Metals and Alloys) were added as master alloys. Magnesium, calcium and boron were weighed and added to liquid aluminum before the $TiO_2$ additions. As it was unknown what amount of titania would be accepted by the melt, fixed amounts of Mg 2 wt. %, Ca 2 wt. %, and B 1 wt. % with respect to the initial quantity of pure liquid aluminum were used or not for each trial.

Regardless of whether Mg, Ca, or B were included, anatase titania exhibited very poor mixing, and separated readily once the mixer stopped. In all cases, except with Mg and Ca and no B (which showed poor mixing/lumpiness), less than 13 wt. % was incorporated, and typically at around 10 wt. % it is clear that no more titania can be added. Sparking and flaring was also observed, indicating poor integration.

Rutile titania, which has exactly the same chemical composition as anatase titania, exhibited very different mixing. While differences in the apparent densities of the anatase (45 microns-0.5 g/cm$^3$) vs. rutile (300 to 350 microns-1.87 g/cm$^3$) were considered to possibly have had some effect (liquid aluminium has a density of 2.4 g/cm$^3$), subsequent experiments with different diameter powders and apparent densities suggest that there is another reason for the different behaviours of these powders, perhaps owing to the crystal structure itself.

With no Mg, Ca or B, the rutile titania did not rise after mixing, but large lumps were included in the melt. Adding only Mg, good mixing is observed up to about 30 wt. %, although surface sparking is observed at higher concentrations of the rutile. Adding B only, or with the Mg makes the clumping worse, and results in separation of the powder once mixing stops.

With Ca but no Mg, the rutile titania exhibited good mixing, little sparking, and no surface segregation when the mixing is stopped. Much more titania could be included. The experiments stopped at 55 wt. %. The slurry with 55 wt. % titania was thick and had a consistency similar to semisolid aluminum billets. The addition of B to this had no appreciable effect.

With Ca and Mg, the mixing was fair, and 55 wt. % of rutile was added. There were some lumps, but no segregation when mixing stopped. Inspection showed wetting was less than without the Mg, and the mixture was not as uniform. With B in addition, there is very poor wetting, and long lived sparks during the addition of the rutile. About 37 wt. % of rutile was added.

The results of the experiments are clearly that using the rutile polymorph had a substantial positive correlation with the ability to integrate more titania in aluminum, that the inclusion of calcium had a substantial positive correlation with the ability to integrate more titania in aluminum (individually or jointly) and that the inclusion of B and Mg are jointly negatively correlated with integration of titania in molten aluminum.

Applicant then produced wedges by high pressure die casting two formulations. In the first, 35 kg of commercially pure aluminum (>99.9%, Al P0404, AIM Metals and Alloys) were melted in an electric furnace. To this, 7 kg of aluminum-calcium master alloy (Al-10% Ca, Rand Alloys) was added. The rutile (>97%, 300-350 μm, ρ=3.9 g/cm$^3$, ρapp=1.87 g/cm$^3$, UGSTM, Rio Tinto Iron and Titanium) was heated to 300° C. for at least 1 hour to remove moisture and mixed to the liquid aluminum in batches of around 300 g until an amount of 51 kg was added. The additions were made with the stir-casting technique using a mixer with a graphite shaft and impeller. The melt temperature was maintained at 700±10° C. during the $TiO_2$ additions. As in the previous tests, aluminum oxidation was reduced with argon (38 L/min) supplied by a ring made with a copper tube (¼") and perforated holes placed above the crucible. The final composition of the mixture in weight percent was: Al-0.75% Ca-54.8% $TiO_2$ and a series of 22 wedges were cast with it.

The second casting campaign was carried out with boron addition. The preparation procedure was the same as the first campaign except that the amounts of components were: 22 kg of the commercially pure aluminum, 4.4 kg of the Al—Ca master alloy, 5.5 kg of Al—B master alloy (Al-4% B, AIM Metals and Alloys) and 36.5 kg of rutile. The final composition of the mixture in weight percent was: Al-0.64% Ca-0.32% B-53.4% TiO2 and a series of 19 wedges were cast.

A high pressure die casting press (Buhler, SC N/53) was used with a die to cast wedge plates and the intensification pressure that was typically 850 bar. Each wedge, with its feeding system and overflows, weighed approximately 2.5 kg and had the following dimensions: L=190 mm, W=100 mm, T=10 to 15 mm. During the first campaign, it was observed that the slurry was thinner at the beginning and thicker towards the end and this may have caused some variations in the amount of ceramic particles in the castings. The consistency of the slurry for the second casting campaign appeared more uniform, probably because of the slightly greater depth of the mixer impeller during preparation. Although the castings produced in both campaigns had, in some instances, surface imperfections, they were all visually in fair condition considering that no attempts were made to optimize the casting parameters.

The solidification of pure aluminum is accompanied with relatively high volume shrinkage (~6.7%) and this is often accompanied by hot tearing. While some modest amount of hot tearing was observed, it is believed to be possible to avoid these defects by optimizing the casting parameters. These castings were subjected to radiographic inspections and metallographic analyses that comprised optical microscopy, scanning electron microscopy (SEM), and energy dispersive X-ray spectroscopy (EDS).

The plates were examined with the X-ray inspection system, revealing the presence of plume-like zones in light gray which were less dense than the background. Since the specific gravity of $TiO_2$ is 3.9 and that of solid aluminum is 2.7, lighter zones are thus considered poorer in $TiO_2$. The density variations may originate from the feedstock with the Al—$TiO_2$ mixture being not entirely uniform or from segregation produced by shear forces during mold filling.

The castings were cut longitudinally at the center. The left hand side of the plate was used to evaluate specific gravity while a sample for microscopy evaluation approximately 4 cm×1.25 cm was extracted from the right hand side, at the mid height. Specific gravity measurements were carried out using Archimedes' principle assuming a law of mixture for pure aluminum and $TiO_2$ and values for their respective specific gravity of 2.7 and 3.9. Even though the values are conservative, as porosity is not accounted for, the $TiO_2$ contents are well below expected, suggesting that a reaction between $TiO_2$ and aluminum may have taken place.

Small samples taken from the right hand side of the wedges were first examined by optical microscopy from which mosaics were made. The one for casting No. 6 at the Al-0.75% Ca-54.8% $TiO_2$ composition is shown in FIGS. 2*a, b* and was found to be typical. FIG. 2*a* shows $TiO_2$ particles imbedded in aluminum and look as though they are sandwiched between a layer of aluminum at the top and bottom. This phenomenon has also been noticed with semi-solid aluminum and is mainly caused by the presence of a shearing gradient in the injected slurry which is maximal at the interface with the die. This gradient acts as a driving force for segregation. The layer is however quite thin (~1 mm) and overall, the particles seem to be relatively well wetted and distributed.

Figure 2C:
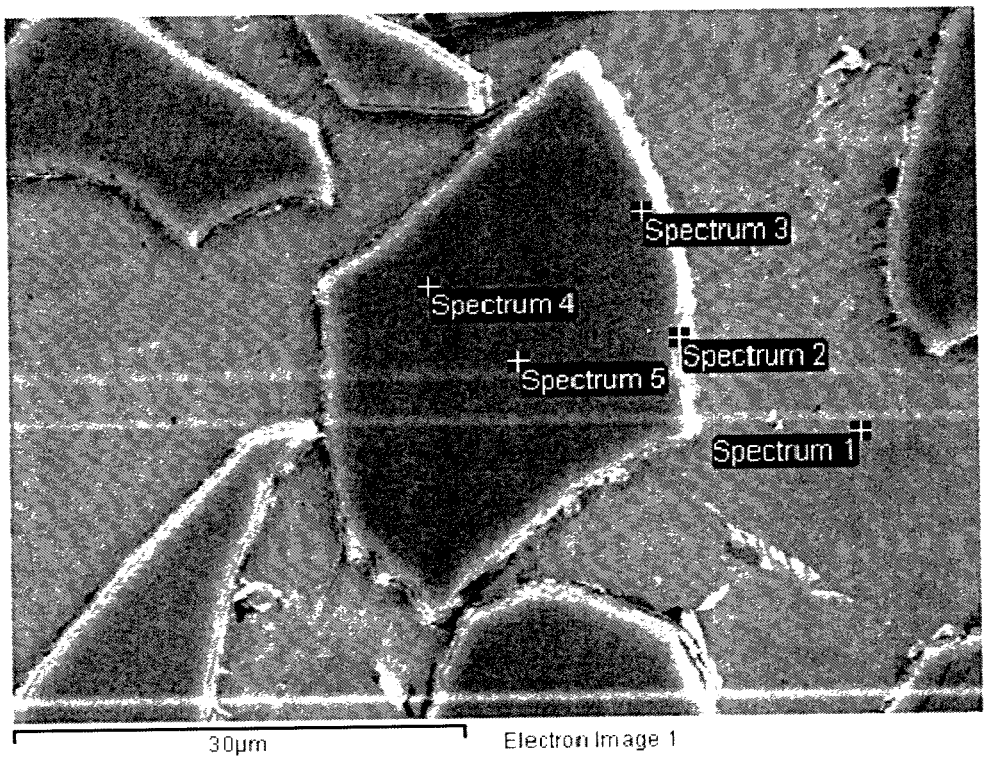
FIGS. 2*a, b, c, d* are images at increasing magnifications of an extracted sample of a wedge in the casting campaign, and an EDS analysis of calcium at the largest magnification.
Figure 2D:
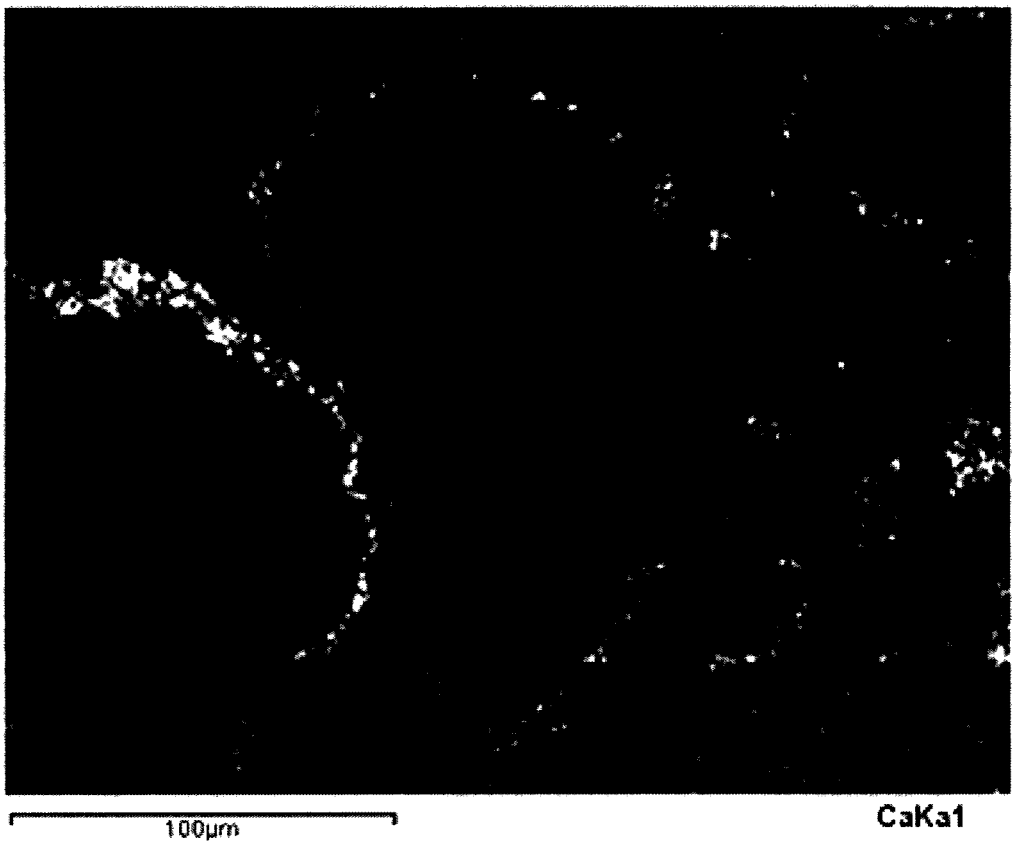

The samples were then examined at larger magnifications (FIG. 2*c*) with a scanning electron microscope (Hitachi SU-70 FEG SEM). FIG. 2*c* provides a picture of embedded ceramic particles around which bright layers with thin border lines can be seen. These layers were observed around all the embedded ceramic particles that were examined, whether boron was added or not. An analysis with an energy dispersive X-ray spectroscopy (EDS) system (Oxford EDS INCA 300) showed that most of the calcium was contained in that layer (see FIG. 2*d*, calcium shown in white). A series of EDS measurements were then carried out to map variations in chemical compositions. As shown in FIG. 2*c*, five locations that systematically corresponded to the following, were used to generate measurements identified as Spectra 1 to 5: Spectrum 1: In the aluminium matrix; Spectrum 2: In the dark layer around the particle; Spectrum 3: In a white part of the particle, just next to the dark layer; Spectrum 4: Inside the particle, at about half the radius; Spectrum 5: Inside the particle, approximately at the center. This analysis generated Table 1 data.

TABLE 1

EDS measured compositions

| Spectrum | O | Al | Si | Ca | Ti | Fe | Total |
|---|---|---|---|---|---|---|---|
| Spectrum 1 | | 99.69 | | | 0.31 | | 100.00 |
| Spectrum 2 | 15.32 | 80.47 | 0.67 | 3.18 | 0.37 | | 100.00 |
| Spectrum 3 | 39.34 | 5.61 | | 0.40 | 54.08 | 0.56 | 100.00 |
| Spectrum 4 | 38.59 | 6.74 | | 0.31 | 53.68 | 0.68 | 100.00 |
| Spectrum 5 | 37.45 | 26.49 | | 0.18 | 35.88 | | 100.00 |

For each sample extracted from the 6 castings, this analysis was repeated on five different particles that were randomly selected for a total of 30 measurements (15 from castings without boron (campaign No. 1) and 15 from castings with boron (campaign No. 2). Differences between the results of the two campaigns are not significant and boron was not detected due to its small content and its low atomic weight. The discussion below thus applies to both sets of results.

The composition at Spectrum 1 was taken in the matrix and consisted, as expected, almost exclusively of aluminum, with some reduced titanium. Spectrum 2, taken in the dark layer around the particles, is rich in aluminum and oxygen but also contains a fair amount of calcium. The presence of this calcium-containing layer bordering the embedded particles provides an explanation for the positive effect that calcium additions had in promoting integration of the particles with aluminum. The titanium content is small at this location. Spectrums 3, 4 and 5, all taken in the pale portion of the particles, show the presence of titanium, oxygen and aluminum at roughly 50 wt %, 35 wt % and 15 wt %, respectively. The 15 wt % aluminum content is relatively high and suggests that a reaction between $TiO_2$ and aluminum took place. The weight percentages of these 3 elements correspond to a compound with an approximate stoichiometry of $Ti_2O_4Al$ or (with respect to 1 mole of atoms) $Ti_{0.286}O_{0.571}Al_{0.143}$. A brief literature review of the Ti—Al—O ternary system has not revealed that compounds with this approximate composition have been reported. Although titanium aluminides such as $Ti_3Al$ and TiAl have some oxygen solubility, the amount measured here (~35 wt %) appears too high to conclude that they are present, but this possibility is not ruled out.

In conclusion, the preparation of an aluminum feedstock containing high concentrations of rutile $TiO_2$ (in excess of 30 wt %, 40 wt. % and 50 wt. %) was made possible by adding a small quantity (<0.75 wt %) of calcium in the aluminum. Boron additions (~0.3 wt %) were not found to have detrimental effects. Magnesium additions were also made (<2 wt %) but the effect was found to be small and negative, despite the prevalent opinion that Mg is the preferred wetting agent for aluminum. Marked differences were observed between anatase and rutile. EDS analysis showed the systematic presence of thin boundary layers around the embedded particles containing calcium. The considerable positive effect of calcium to the integration of $TiO_2$ was attributed to the formation of this layer. The particles which initially consisted of $TiO_2$ (60 wt % titanium and 40% oxygen) reacted and were found after integration to the melt to consist of titanium (50 wt %), oxygen (35 wt %) and aluminum (15 wt %).

Two test bars were tested to estimate strength. The bars were composed of a matrix of Aluminum (>99 wt % purity) with particles that were $TiO_2$ Rutile (>97 wt. % purity)+ Silica (<3 wt. %) The particle granulometry was dp 50 of 300-350 μm. The particle content in the matrix was ~55 wt. %. The plates were extracted from high pressure die cast plates in the as-cast condition (no heat treatment, tempering or annealing). The bars were finished as required by ASTM standards for strength testing. Nonetheless, useful information about the bars were observed. The Young's modulus for the material was observed to be about 80±0.5 GPa; the yield strength was found to be 54±2 MPa; the tensile strength was found to be 64±10 MPa; and the elongation was found to be 1.5±1%. These values appear to compare favourably with commercially available MMCs.

A casting campaign was carried out with finer rutile powders (>99 wt. % purity), and found that even with nominally 30-50 μm powders, 55 wt. % of rutile could be incorporated, although this was approaching a limit for the specific composition.

Other advantages that are inherent to the structure are obvious to one skilled in the art. The embodiments are described herein illustratively and are not meant to limit the scope of the invention as claimed. Variations of the foregoing embodiments will be evident to a person of ordinary skill and are intended by the inventor to be encompassed by the following claims.

The invention claimed is:

1. A method for producing a metal matrix composite comprising:

stirring a reinforcement with an aluminum-containing molten or semisolid metal or alloy and between 0.005 and 10 wt. % calcium (Ca) to form a mixture, wherein the reinforcement is composed of particles each having a surface with a surface area bearing at least 20% of titanium oxide ($TiO_2$), and the $TiO_2$ is of crystal form other than anatase; and cooling the mixture to produce a solid metal matrix composite to form a boundary material system between the crystals and the matrix, the boundary material system comprising calcium and aluminum oxides.

2. The method of claim 1 wherein the reinforcement is a cermet or ceramic powder including the $TiO_2$, or a compound coated with the $TiO_2$.

3. The method of claim 1 wherein the $TiO_2$ is in a rutile crystal form.

4. The method of claim 1 wherein at least 60 wt. % of the mixture comprises the reinforcement and molten metal or alloy.

5. The method of claim 1 wherein the molten or semisolid metal is liquid aluminum with at least 80 wt. % or more of Al.

6. The method of claim 1 wherein the molten metal or alloy includes aluminum, and at least one alloying metal in liquid or semisolid form with the aluminum, the alloying metal being a metal other than magnesium.

7. The method of claim 1 wherein the particles are spherical, cubic, prismatic, polyhedral, angular, amorphous, elongated, rod-like, tubular, conic, fibrous, filamentary, platelet-like, disc-like, irregular, or any combination of the above.

8. The method of claim 1 wherein the surfaces of the particles are flat or curved, smooth or rough, randomly textured or patterned, concave or convex, or any combination of the above.

9. The method of claim 1 wherein the particles have a predefined distribution of dimensions, with less than 10% of the powders having dimensions greater than a maximum dimension, which is less than 1 cm, and with less than 10% of the powders having dimensions smaller than a minimum dimension, which is greater than 10 nm.

10. The method of claim 1 wherein each surface of the typical particle has a surface area with at least 20% of $TiO_2$.

11. The method of claim 10 wherein each surface of the typical particle bears at least 60% of $TiO_2$.

12. The method of claim 1 wherein cooling the mixture to produce a solid metal matrix composite comprises: sand-casting, die casting, centrifugal casting, compocasting, thixocasting, rheocasting, thixomolding or other semisolid casting, pressure die casting, injection molding or extrusion.

13. The method of claim 1 wherein at least 80 wt. % of the mixture comprises the reinforcement and molten metal or alloy.

14. The method of claim 1 wherein at least 97 wt. % of the mixture comprises the reinforcement and molten metal or alloy.

15. The method of claim 1 wherein the calcium is added to the liquid or semisolid aluminum prior to introduction of the reinforcements.

16. The method of claim 1 wherein the calcium is added in an amount of 0.005 to 5 wt. %.

17. The method of claim 1 wherein the calcium is added in an amount of 0.01 to 2.5 wt. %.

18. A metal matrix composite (MMC) comprising:

a metal matrix of an aluminum or an alloy of aluminum; and numerous sub-millimeter dimension embedded particles of a ceramic distributed throughout the metal matrix, the embedded particles comprising crystals of titanium oxide ($TiO_2$) in crystal form other than anatase, wherein 0.005 to 10 wt. % calcium is present, and a boundary material system is formed between the crystals and the matrix, the boundary system comprising calcium and aluminum oxides.

19. The MMC of claim 18 wherein the calcium present is in an amount of 0.005 to 5 wt. %.

20. The MMC of claim 18 wherein the crystals are of rutile crystal form.

21. The MMC of claim 20 wherein the calcium is more highly concentrated within the boundary material system than within the embedded particles.

22. The MMC of claim 20 wherein the ceramic particles are composed of a ceramic oxide, boride, carbide, nitride or graphite coated with the rutile $TiO_2$.

23. The MMC of claim 20 wherein the ceramic particles are composed of an oxide or boride, or a ceramic that has a naturally formed oxidization layer coated with the rutile $TiO_2$.

24. The MMC of claim 18 wherein the calcium present is in an amount of 0.01 to 2.5 wt. %.

25. The MMC of claim 18 wherein the ceramic particles are spherical, cubic, prismatic, polyhedral, angular, amorphous, elongated, rod-like, tubular, conic, fibrous, filamentary, platelet-like, disc-like, irregular, or any combination of the above.

26. The MMC of claim 18 wherein the ceramic particles have a predefined distribution of dimensions, with less than 10% of the powders having dimensions greater than a maximum dimension, which is less than 1 cm, and with less than 10% of the powders having dimensions smaller than a minimum dimension, which is greater than 10 nm.

27. A method for reducing melt loss due to calcium defects in parts formed from an aluminum or aluminum alloy melt, the method comprising estimating a molar amount of calcium present, and adding at least an equal molar amount of rutile titania to the aluminum or aluminum alloy melt to form within the aluminum a boundary material system between crystals of the rutile titania and the aluminum, the boundary system comprising calcium and aluminum oxides.

28. A method for producing a metal matrix composite comprising:

at least partially melting an aluminum metal or alloy to form a molten or semisolid metal or alloy containing between 0.005 and 10 wt. % calcium (Ca);

stirring into the metal or alloy a reinforcement composed of particles of titanium oxide ($TiO_2$) of a crystal form other than anatase to form a mixture; and cooling the mixture to produce a solid metal matrix composite forming a boundary material system between the crystals and the matrix, the boundary material system comprising calcium and aluminum oxides.

29. The method of claim 28 wherein the $TiO_2$ is in a rutile crystal form.

30. The method of claim 28 wherein at least 60 wt. % of the mixture comprises the reinforcement and molten metal or alloy.

31. The method of claim 28 wherein at least 97 wt. % of the mixture comprises the reinforcement and molten metal or alloy.

32. The method of claim 28 wherein the molten or semisolid metal or alloy comprises at least 80 wt. % of liquid aluminum.

33. The method of claim 28 wherein the molten or semisolid metal or alloy includes aluminum, and at least one alloying metal in liquid or semisolid form with the aluminum, the one alloying metal being a metal other than magnesium.

34. The method of claim 28 wherein the particles are spherical, cubic, prismatic, polyhedral, angular, amorphous, elongated, rod-like, tubular, conic, fibrous, filamentary, platelet-like, disc-like, irregular, or any combination of the above.

35. The method of claim 28 wherein the particles have surfaces that are: flat or curved, smooth or rough, randomly textured or patterned, concave or convex, or any combination of the above.

36. The method of claim 28 wherein the particles have a predefined distribution of dimensions, with less than 10% of the powders having dimensions greater than a maximum dimension, which is less than 1 cm, and with less than 10% of the powders having dimensions smaller than a minimum dimension, which is greater than 10 nm.

37. The method of claim 28 wherein cooling the mixture to produce a solid metal matrix composite comprises: sand-casting, die casting, centrifugal casting, compocasting, thixocasting, rheocasting, thixomolding or other semisolid casting, pressure die casting, injection molding or extrusion.

38. The method of claim 28 wherein the calcium is added in an amount of 0.005 to 5 wt. %.

39. The method of claim 28 wherein the calcium is added in an amount of 0.01 to 2.5 wt. %.

40. A cast part comprising:

a metal matrix of an aluminum or an alloy of aluminum; and numerous sub-millimeter dimension embedded particles of a ceramic distributed throughout the metal matrix, the embedded particles comprising crystals of titanium oxide ($TiO_2$) in crystal form other than anatase, wherein 0.005 to 10 wt. % calcium is present, and a boundary material system is formed between the crystals and the matrix, the boundary system comprising calcium and aluminum oxides.

41. The cast part of claim 40 wherein the calcium is more highly concentrated within the boundary material system than within the embedded particles.

42. The cast part of claim 40 wherein the crystals are of rutile crystal form.

43. The cast part of claim 40 wherein the ceramic particles are composed of a ceramic oxide, boride, carbide, nitride or graphite coated with the rutile $TiO_2$.

44. The cast part of claim 40 wherein the ceramic particles are spherical, cubic, prismatic, polyhedral, angular, amorphous, elongated, rod-like, tubular, conic, fibrous, filamentary, platelet-like, disc-like, irregular, or any combination of the above.

45. The cast part of claim 40 wherein the ceramic particles have a predefined distribution of dimensions, with less than 10% of the powders having dimensions greater than a maximum dimension, which is less than 1 cm, and with less than 10% of the powders having dimensions smaller than a minimum dimension, which is greater than 10 nm.

46. The cast part of claim 40 wherein the calcium present is in an amount of 0.005 to 5 wt. %.

47. The cast part of claim 40 wherein the calcium present is in an amount of 0.01 to 2.5 wt. %.

* * * * *